United States Patent [19]

von der Eltz

[11] Patent Number: 4,592,107

[45] Date of Patent: Jun. 3, 1986

[54] PROCESS AND APPARATUS FOR THE CONTINUOUS TREATMENT OF TEXTILE MATERIAL IN ROPE FORM

[75] Inventor: Hans-Ulrich von der Eltz, Frankfurt am Main, Fed. Rep. of Germany

[73] Assignee: Hoechst Aktiengesellschaft, Fed. Rep. of Germany

[21] Appl. No.: 625,104

[22] Filed: Jun. 27, 1984

[30] Foreign Application Priority Data

Jun. 29, 1983 [DE] Fed. Rep. of Germany ..... 3323381

[51] Int. Cl.[4] ..... D06B 21/00

[52] U.S. Cl. ..... 8/149.1; 8/151; 68/5 D; 68/20; 68/62

[58] Field of Search ..... 8/149.1, 151; 68/5 D, 68/5 E, 9, 20, 62, 177, 178

[56] References Cited

U.S. PATENT DOCUMENTS

| | | | |
|---|---|---|---|
| 761,107 | 5/1904 | Rovira | 68/9 X |
| 1,033,925 | 7/1912 | Palmer | 68/178 X |
| 1,758,174 | 5/1930 | Riggs | 68/62 X |
| 1,825,478 | 9/1931 | Rowley et al. | 68/62 X |
| 2,785,042 | 3/1957 | Grajeck et al. | 68/5 D X |
| 3,330,134 | 7/1967 | Carpenter | 68/9 |
| 3,718,012 | 2/1973 | Vinas | 68/5 D X |
| 3,981,162 | 9/1976 | Klier | 68/9 X |
| 4,006,612 | 2/1977 | Thies | 68/9 X |
| 4,016,733 | 4/1977 | Fleissner | 68/62 X |

*Primary Examiner*—Philip R. Coe

*Attorney, Agent, or Firm*—Connolly and Hutz

[57] ABSTRACT

The crease displacement and the achievable dilution factor in the conventional continuous pretreatment or aftertreatment operations of fabric ropes with liquid means in rope washers are not adequate, and consequently the water consumption necessary for satisfactory results is too high. To date the existing problems can only be solved with squeeze rollers which, however, have an adverse effect on the goods.

According to the invention the textile rope is now introduced into a treatment store of a liquid-operated jet apparatus, is subjected to the action of the treatment liquor, is then carried along by a steam- or more generally gas-operated jet arrangement and conveyed into an interim store, where dewatering takes place. From the interim store the goods, with satisfactory dilution factor, are then passed to the next isothermal or non-isothermal treatment stage of the same or a very similar structure.

10 Claims, 3 Drawing Figures

PROCESS AND APPARATUS FOR THE CONTINUOUS TREATMENT OF TEXTILE MATERIAL IN ROPE FORM

The present invention relates to a process for the continuous treatment of woven or knitted textiles in rope form with liquid treatment agents and to a suitable apparatus which works on the jet principle to carry the fiber material through the unit.

The continuous treatment of dyeings on open-width fabric webs with, for example, wash or cleaning liquors, for the purpose of improving the dyeing effects, is surely sufficiently well known common knowledge. And continuous pretreatment or aftertreatment operations are not even any longer new in the case of woven and knitted fabrics used in rope form. These operations are generally carried out in a rope washer or an apparatus like it.

As is known in this respect, in this type of process the so-called dilution factor in the individual compartments of the continuous unit is extremely critical for the effectiveness of the treatment. In the given situation, however, those skilled in the art tend to think that continuous washers inevitably lead to a high water consumption, since the liquor carried over each time into the next bath only produces a limited dilution effect on the dirt present on the goods.

Ideally the liquor is therefore passed through the treatment zones in countercurrent flow, which can be conducted isothermally or with the temperature decreasing in successive treatment compartments. To obtain a favorable dilution factor the textile material is therefore squeezed off between the various treatment stages. However, such a dewatering measure puts the goods under severe mechanical stress and, what is more, not even uniformly so. Moreover, crease displacement in rope washers leaves much to be desired.

Problems similar to those above also arise in the use of jet continuous washer, where likewise too much liquor is carried over from bath to bath, so that the end result is an unfavorable dilution factor.

It is thus an object of the present invention to provide such a continuous treatment process for woven and/or knitted fabrics in rope form on jet machines as is free of the above-described disadvantages of the conventional, state of the art methods in this field and nevertheless permits an intensive, uniform treatment. Another object is to present an apparatus in which the fiber material is transported by jet drive and which makes possible such a treatment.

It has been found that the first of the objects specified in the preceding paragraph can be satisfactorily achieved and improved dewatering of the textile material between the individual wet-treatment stages can be obtained without the need for squeeze rollers which have an adverse effect on the appearance of the goods if the novel drive principle which is described in issued European Patent Application EP-A-0,014,919 for guiding goods in endless form by means of gas- or, more specifically, steam-operated jets is applied to the measures for the continuous forward movement of the goods being treated and is made use of, in the course of the pretreatment and aftertreatment of textile ropes circulating in the long, untied form, during the passage through a plurality of successive different-purpose units of the machine.

The present invention thus provides a process for treating textile woven or knitted fabric ropes guided in the long form through jet apparatus during their continuous passage through various successive but separate wet-treatment zones of the apparatus and through as many, preferably different treatment liquids by alternately exerting the forward force for the transport of the fiber material within the self-contained unit with hydraulic or pneumatic drive from successively actuating the jet system from one different treatment stage to the next, which comprises (a) supplying a treatment liquor to the textile rope entering a wet-treatment zone on its passing through a liquid-operated jet arrangement, thereby simultaneously forcing the rope into an immediately following storage space filled with the same liquid medium, where the rope, continuously moving forward in the plaited state, is subjected to the action of the treatment liquid, (b) continuously removing the textile rope thus wet-treated, after its passage through the storage space according to (a), from this storage space by means of a downstream steam- or, more generally, gas-operated jet arrangement and then feeding it into a subsequent interim store where in the course of the dwell time there the textile rope, continuously moving forward in the plaited state, is largely freed of the treatment liquid from the preceding wet-treatment stage (a), and by, finally, (c) repeating treatment stages (a) and (b), if desired more than once, in the same order together with the application of optionally different treatment agents or treatment conditions preferably for wet-treatment operation (a), whereupon the textile rope leaves the unit, again continuously.

The new process just described offers, very generally, a number of advantages over the conventional techniques of the field in question especially by virtue of the fact that owing to the repeated action of liquid agents on the textile rope it can, as a rule, be adapted to virtually any desired project or sequence. In other words, it is distinguished by the large number of possible treatment operations of the type in question.

On such a basis it is possible, according to the invention, to carry out all or some of the successive wet-treatment steps which all relate to the same measures and which may be combined into groups even under the influence of liquor flowing against the transport direction of the goods and—if necessary—even under isothermal conditions. In this situation the advantageous results are a low consumption of water and a considerable saving in energy but also time. Moreover, the cloth need not be especially put into the open-width form for the aftertreatment.

If the present invention is carried out using the countercurrent principle, the liquid-operated exit jet is in each case fed with the liquor of the storage unit of the next wet-treatment step. However, each such treatment step in the process can also be fed separately with fresh liquor. By admixing water at any desired temperature to the liquor passing in countercurrent to the moving cloth it is possible, in coordination with the wet-operation measures to be taken at the place in question, to carry out the treatment operation in every individual stage at the intended temperature.

The fact—characteristic of the new process—that the moist textile material arriving from a preceding wet-treatment is stored for a while and that it is dewatered during said storage, results in the most suitable dilution factors for each treatment stage.

The continuous jet-driven forward motion of the textile rope through the various treatment zones—which forward motion is brought about and kept going by the kinetic energy transferred to the fiber material by the beam of jet impacting in the transport direction—has the additional effect of giving satisfactory displacement of creases. If now in addition the water adhering to the textile rope is sucked off by means of an annular suction nozzle, the results in terms of dilution are better still. Such annular suction nozzles can in principle be arranged immediately downstream of the steamor more generally gas-fed jets, in the fabric transport direction, but particularly advantageously they are present at the outlet of the intermediate storage space for the textile material already largely dewatered in the course of the dwell phase.

The forward movement of the goods by means of a liquid-operated jet arrangement and/or by means of a steam- or more generally gas-operated jet arrangement can be supported in the new process by means of a driven winch in order to preserve the quality of the goods. In the case of consecutive isothermal treatment stages it is advisable in some cases to interpose winch drives only.

It is similarly found to be advantageous for the process additionally to spray down the textile rope before entry into the next stream- or more generally gas-operated jet arrangement, in particular in succession to a textile-finishing wet-treatment operation, and to feed the resulting spray water, which contains any residues of the treatment agent applied in the preceding stage which have not been absorbed by the fiber material, to the upstream liquid-operated jet.

In an apparatus which is suitable for carrying out the claimed process and to which the present invention likewise relates, essentially comprising a succession of jet drive systems for continuously passing a textile rope in the long form alternately through self-contained separate zones with cloth inlet and cloth outlet for a wet-treatment operation and for a subsequent dewatering of the passing textile material thus wet-treated, there are present, in the stated order, (a)—at the cloth inlet to the wet-treatment zone—a liquid-operated jet arrangement, if desired with upstream drivable winch, (b) an immediately following storage space holding treatment liquor and the passing textile rope, (c) a steam- or more generally gas-operated jet arrangement at the cloth outlet of (b), if desired with an upstream, drivable winch and (d) an interim store directly connected to (c) for the textile material plus means for discharging it of treatment liquor from (a) and/or (b) running off the dwelling textile rope and for letting out the goods, and (e) the pipes which are required for operating the jet arrangements and in which driving means in the form of liquids or gases or more specifically steam are supplied, plus the associated pumps and blowers.

Novel features and advantages of the present invention in addition to those enumerated above will become apparent from a reading of the following detailed description in conjunction with the accompanying drawing wherein similar reference characters are used to identify similar parts and in which.

The roman numerals I, II and III each relate to the consecutive stages of the treatment in question involving wet operation measures and dewatering.

The Fs are the liquid-operated jets for advancing textile rope T plus the associated pipes for drawing the liquor out of the immediately following treatment stage by means of built-in pump P or fresh water by way of an appropriate inlet W.

S is the storage space for the actual phase during which treatment liquids act on the passing textile material T, possibly combined with a liquor overflow U.

The Ds are the steam- or more generally gas-operated jets for advancing the cloth, plus the associated blower G and possibly a heat exchanger (not depicted).

The jets can incidentally also be in the form of double jets F and/or D, so that they can be optionally used for liquid or steam drive.

Figure 2:
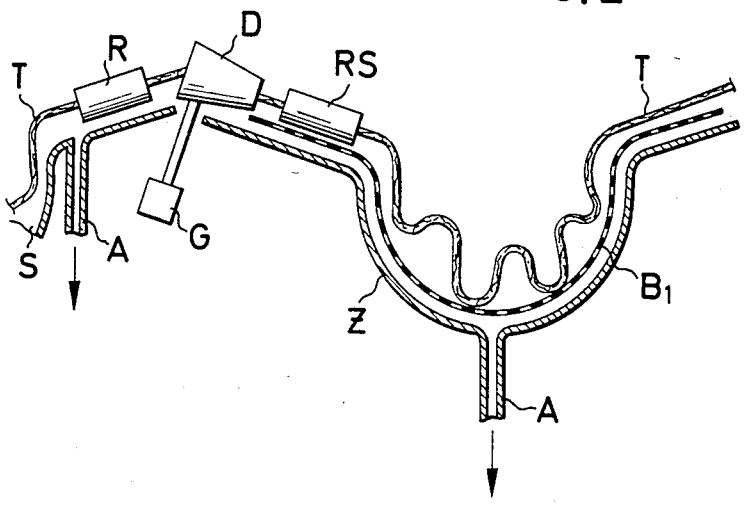
FIG. 2 is an enlarged partial view from FIG. 1 illustrating an alternate embodiment having annular suction nozzles and wherein the interim store is double-walled with a perforated inner wall.
Figure 3:
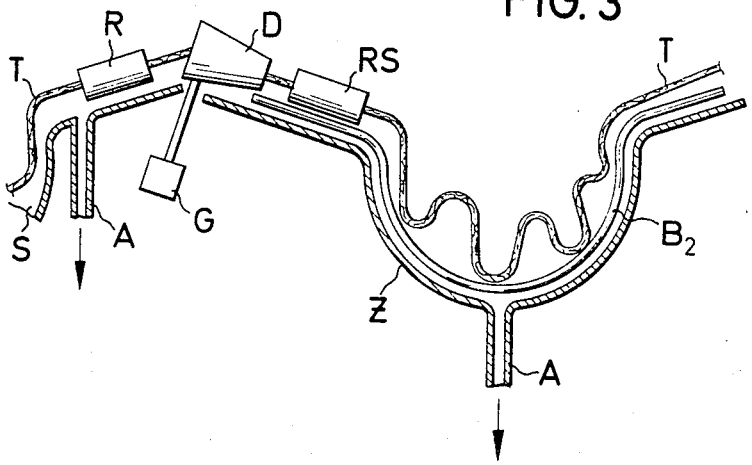
FIG. 3 is an enlarged partial view from FIG. 1 illustrating an alternate embodiment wherein the interim store is double-walled with an inner wall of side-by-side slide bars.

The Zs are the interim stores which, in the case depicted in FIG. 2, are double-walled with a perforated inner wall B1 for collecting as well as discharging the waste water A. In another variant of the claimed apparatus shown in FIG. 3, interim storage space Z can be equipped at the bottom with side by side slide bars B2 for the goods passing through.

In line with the illustrative example depicted in the Figures treatment stage I can also contain means for spraying down the textile rope, such as the annular spray nozzle R and an associated drainage plate for the resulting waste water A, and/or an annular suction nozzle RS for drawing out the adhering water. Where exactly in the unit according to the invention these additional means are mounted largely depends on the desired way of carrying out the process.

Figure 1:
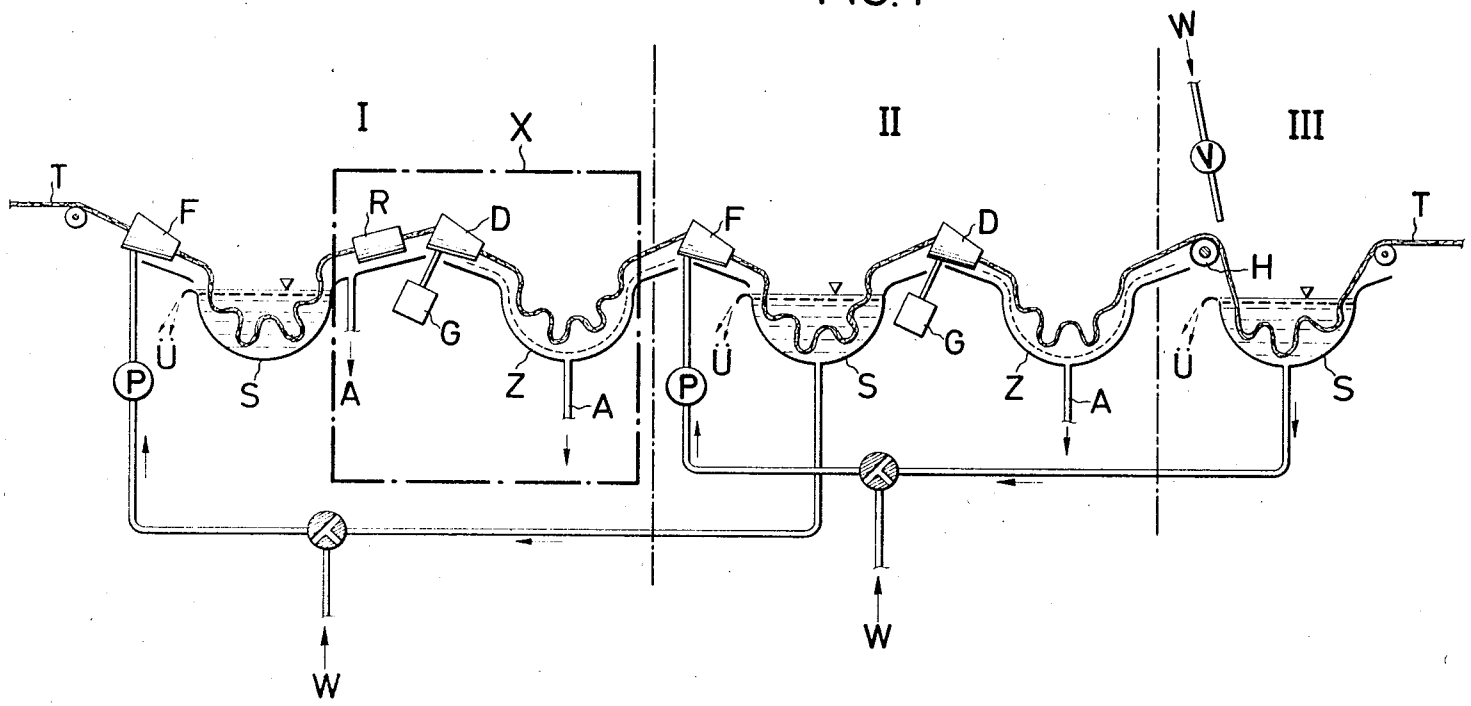
FIG. 1 is a schematic side view of an apparatus for treating textile rope material.

According to the drawing FIG. 1 treatment stage III merely has a winch H as a drive element for the textile rope. However, in some cases it is advisable to carry the textile material forward by means of a combination of winch H and jets. In order to keep the design of the unit as simple as possible, the textile rope will be transported with liquid-operated jets only between treatment stages at different temperatures. If the treatment temperatures are the same the rope can be advanced by winches alone.

According to the invention it is of course also possible to vary the dwell times of the moving goods in the stores with their size, so that, depending on the dimensions of the apparatus, this too gives wide scope for varying the aftertreatment.

I claim:

1. A process for treating textile woven or knitted fabric rope guided through jet apparatus during the continuous passage of the rope through various successive but separate wet-treatment zones of the apparatus, the process comprising the steps of supplying a treatment liquor to the textile rope entering a wet-treatment zone as the rope passes through a liquid-operated jet arranged to move the rope along its path of travel, simultaneously forcing the rope into an immediately following storage space filled with the same treatment liquid, where the continuously moving rope is subjected to the action of the treatment liquid, continuously removing the textile rope thus wet-treated from the storage space by a downstream steam- or gas-operated jet, and feeding the rope into a subsequent interim store where the continuously moving rope is largely freed of the previously applied treatment liquid.

2. The process as claimed in claim 1, including the step of assisting the movement of the rope along its path of travel by means of a driven winch.

3. The process as claimed in claim 1, including the step of passing the treatment liquor through the successive wet-treatment stages countercurrent to the path of travel of the rope.

4. The process as claimed in claim 1, wherein the individual successive wet-treatment stages are carried out under isothermal conditions.

5. The process as claimed in claim 1, including the step of spraying the textile rope immediately before it enters the steam- or gas-operated jet.

6. An apparatus for treating textile woven or knitted fabric rope comprising a liquid-operated jet arranged to receive and move the rope along its path of travel, an immediately following storage space holding treatment liquor and arranged to receive the passing textile rope, a steam- or gas-operated jet arranged downstream of the storage space to receive and move the rope along its path of travel, and an interim store directly downstream from the steam- or gas-operated jet for receiving the textile rope and freeing the rope of the previously applied treatment liquid.

7. The apparatus as claimed in claim 6, including annular spray nozzles and drainage plates immediately upstream from the steam- or gas-operated jet for spraying the rope with liquid.

8. The apparatus as claim in claim 6, including annular suction nozzles immediately downstream from the steam- or gas-operated jet for removing liquid from the rope.

9. The apparatus as claimed in claim 6, wherein the interim store is double-walled with a perforated inner wall.

10. The apparatus as claimed in claim 6, wherein the interim store is double walled with an inner wall of side-by-side slide bars.

* * * * *